US006109187A

United States Patent [19]

Cottle et al.

[11] Patent Number: 6,109,187

[45] Date of Patent: Aug. 29, 2000

[54] FOLDING WORK TABLE

[76] Inventors: Michael Cottle; Carol Cottle, both of 6474 Gaddis Dr., Fayetteville, N.C. 28306

[21] Appl. No.: 09/365,041

[22] Filed: Jul. 30, 1999

[51] Int. Cl.[7] ..... A47B 23/00

[52] U.S. Cl. ..... 108/42; 108/115

[58] Field of Search ..... 108/42, 48, 55.1, 108/27, 115; 269/55, 56, 289 R, 293

[56] References Cited

U.S. PATENT DOCUMENTS

| | | | |
|---|---|---|---|
| 969,684 | 9/1910 | Cline | 108/47 |
| 3,736,884 | 6/1973 | Kohner | 108/48 |
| 4,155,609 | 5/1979 | Skafte et al. | 108/48 X |
| 5,469,794 | 11/1995 | Laderoute et al. | 108/48 |

*Primary Examiner*—Jose V. Chen

[57] ABSTRACT

A folding work table for mounting to a wall structure so that the folding work table may be folded out of the way when not in use. The folding work table includes a table top with a support leg structure pivotally coupled to a lower face of the table top adjacent a first end edge of the table top. A mounting board is pivotally coupled to a second end edge of the table top. The lower face of the table top has a generally U-shaped track with an elongate channel extending therealong. At least one C-clamp is provided having a generally C-shaped frame has a pair of opposing ends defining a break therebetween. One of the ends of the frame of the C-clamp has a pivot ball slidably disposed in the channel of the track.

6 Claims, 2 Drawing Sheets

FOLDING WORK TABLE

BACKGROUND OF THE INVENTION

1. Field of the Invention

The present invention relates to folding work tables and more particularly pertains to a new folding work table for mounting to a wall structure so that the folding work table may be folded out of the way when not in use.

2. Description of the Prior Art

The use of folding work tables is known in the prior art. More specifically, folding work tables heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. 5,322,022; U.S. Pat. No. 4,437,414; U.S. Pat. No. 2,239,225; U.S. Pat. No. 3,648,628; U.S. Pat. No. 2,484,326; and U.S. Pat. No. Des. 295,007.

While these devices fulfill their respective, particular objectives and requirements, the aforementioned patents do not disclose a new folding work table. The inventive device includes a table top with a support leg structure pivotally coupled to a lower face of the table top adjacent a first end edge of the table top. A mounting board is pivotally coupled to a second end edge of the table top. The lower face of the table top has a generally U-shaped track with an elongate channel extending therealong. At least one C-clamp is provided having a generally C-shaped frame has a pair of opposing ends defining a break therebetween. One of the ends of the frame of the C-clamp has a pivot ball slidably disposed in the channel of the track.

In these respects, the folding work table according to the present invention substantially departs from the conventional concepts and designs of the prior art, and in so doing provides an apparatus primarily developed for the purpose of mounting to a wall structure so that the folding work table may be folded out of the way when not in use.

SUMMARY OF THE INVENTION

In view of the foregoing disadvantages inherent in the known types of folding work tables now present in the prior art, the present invention provides a new folding work table construction wherein the same can be utilized for mounting to a wall structure so that the folding work table may be folded out of the way when not in use.

The general purpose of the present invention, which will be described subsequently in greater detail, is to provide a new folding work table apparatus and method which has many of the advantages of the folding work tables mentioned heretofore and many novel features that result in a new folding work table which is not anticipated, rendered obvious, suggested, or even implied by any of the prior art folding work tables, either alone or in any combination thereof.

To attain this, the present invention generally comprises a table top with a support leg structure pivotally coupled to a lower face of the table top adjacent a first end edge of the table top. A mounting board is pivotally coupled to a second end edge of the table top. The lower face of the table top has a generally U-shaped track with an elongate channel extending therealong. At least one C-clamp is provided having a generally C-shaped frame has a pair of opposing ends defining a break therebetween. One of the ends of the frame of the C-clamp has a pivot ball slidably disposed in the channel of the track.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new folding work table apparatus and method which has many of the advantages of the folding work tables mentioned heretofore and many novel features that result in a new folding work table which is not anticipated, rendered obvious, suggested, or even implied by any of the prior art folding work tables, either alone or in any combination thereof.

It is another object of the present invention to provide a new folding work table which may be easily and efficiently manufactured and marketed.

It is a further object of the present invention to provide a new folding work table which is of a durable and reliable construction.

An even further object of the present invention is to provide a new folding work table which is susceptible of a low cost of manufacture with regard to both materials and labor, and which accordingly is then susceptible of low prices of sale to the consuming public, thereby making such folding work table economically available to the buying public.

Still yet another object of the present invention is to provide a new folding work table which provides in the apparatuses and methods of the prior art some of the advantages thereof, while simultaneously overcoming some of the disadvantages normally associated therewith.

Still another object of the present invention is to provide a new folding work table for mounting to a wall structure so that the folding work table may be folded out of the way when not in use.

Yet another object of the present invention is to provide a new folding work table which includes a table top with a support leg structure pivotally coupled to a lower face of the table top adjacent a first end edge of the table top. A mounting board is pivotally coupled to a second end edge of the table top. The lower face of the table top has a generally U-shaped track with an elongate channel extending therealong. At least one C-clamp is provided having a generally C-shaped frame has a pair of opposing ends defining a break therebetween. One of the ends of the frame of the C-clamp has a pivot ball slidably disposed in the channel of the track.

Still yet another object of the present invention is to provide a new folding work table that has a pair of C-clamps slidably mounted to a track along the lower face of the table top to permit adjustable positioning of the clamps to clamp items to the table top.

Even still another object of the present invention is to provide a new folding work table that may also be mounted to other structures such as countertops, and even vehicles such as to the load bed of a pickup truck.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
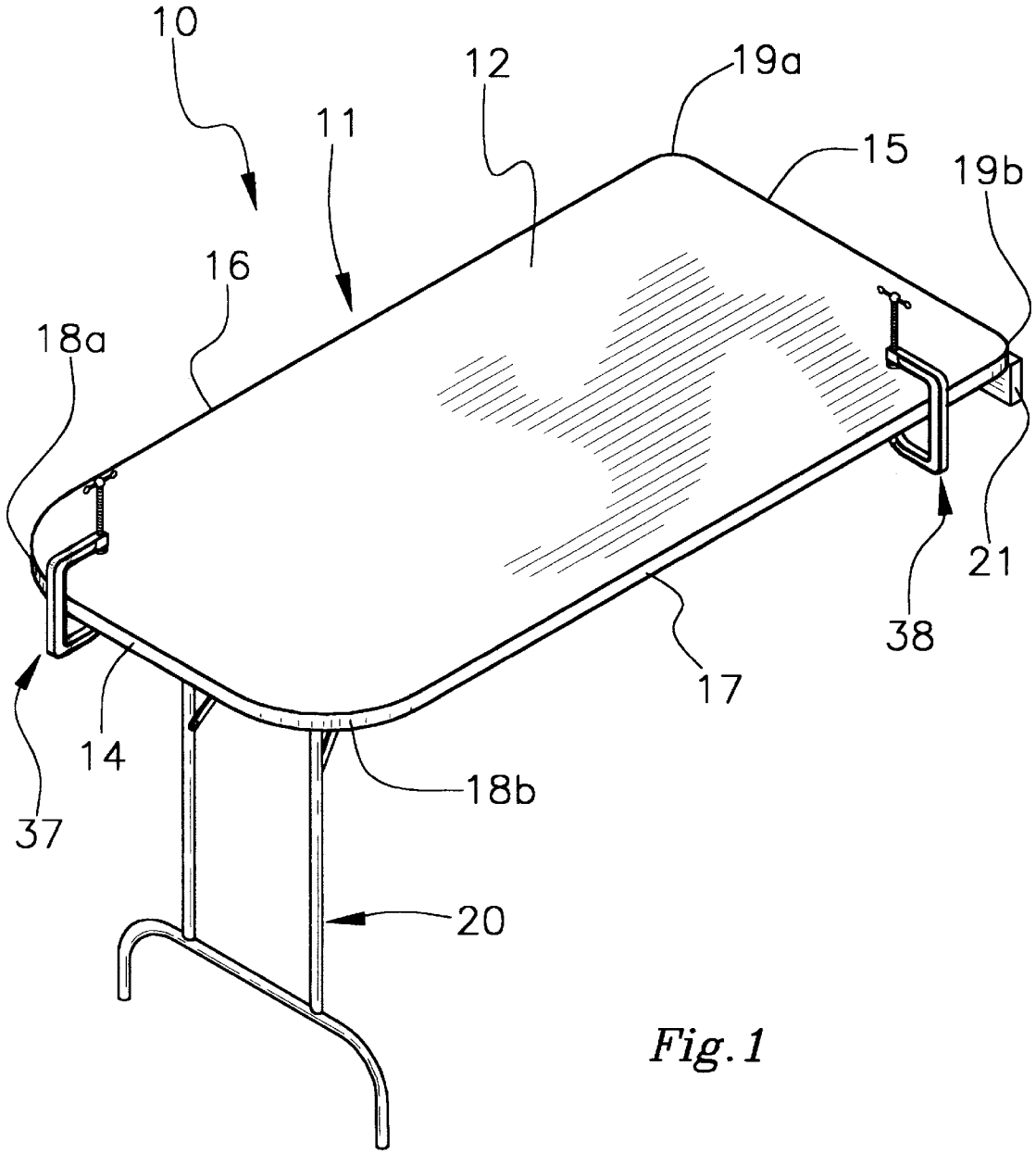
FIG. 1 is a schematic perspective view of a new folding work table in a deployed position according to the present invention.
Figure 2:
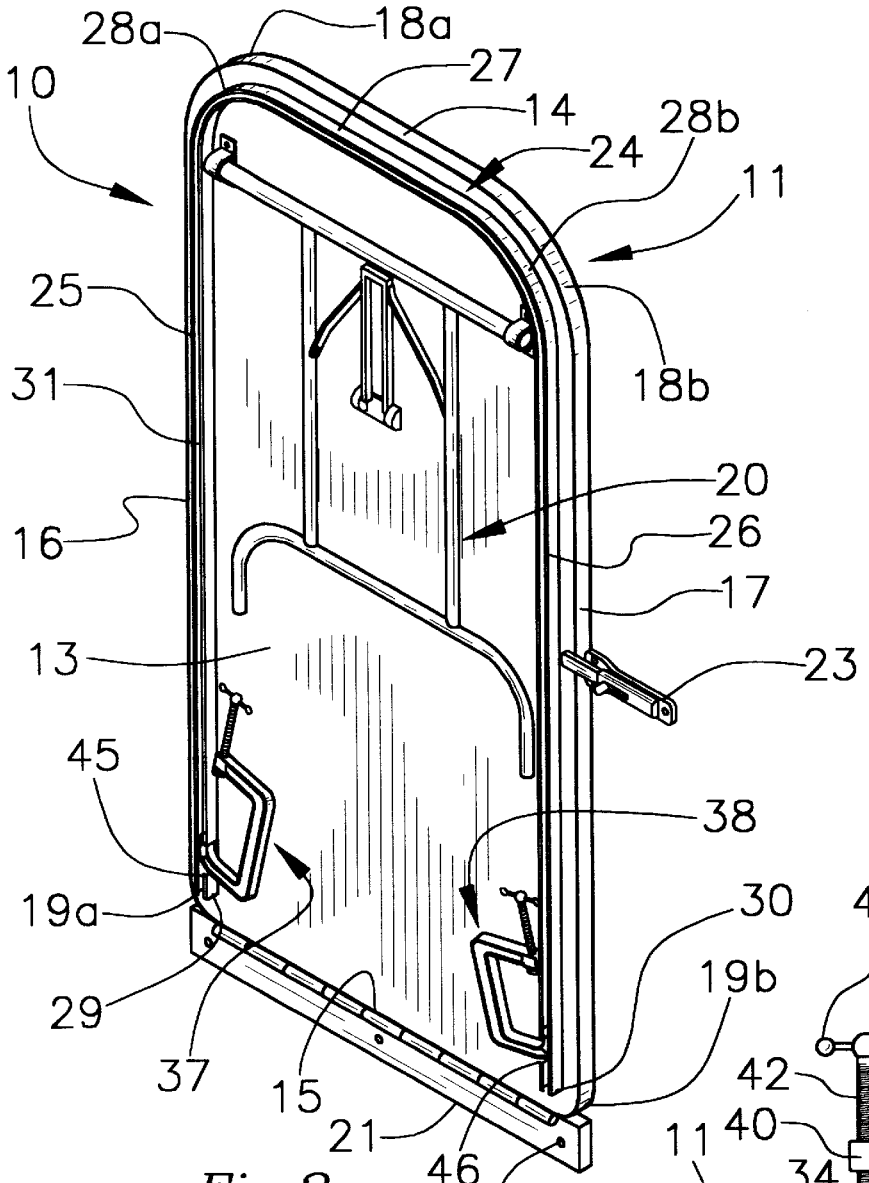
FIG. 2 is a schematic perspective view of the present invention in a folded up position.
Figure 3:
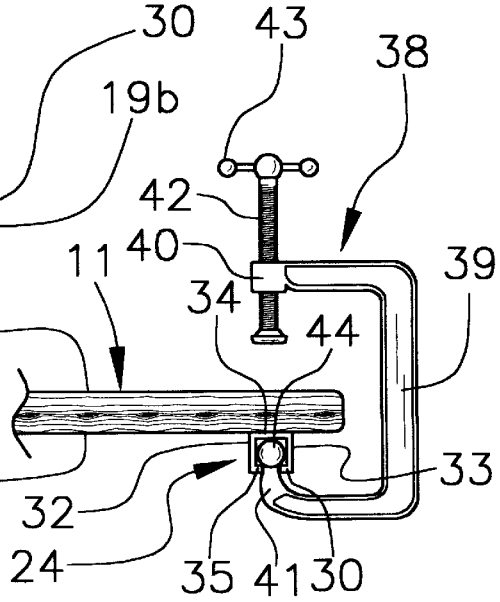
FIG. 3 is a schematic side view of the present invention illustrating the pivot ball in the channel of the track.

With reference now to the drawings, and in particular to FIGS. 1 through 3 thereof, a new folding work table embodying the principles and concepts of the present invention and generally designated by the reference numeral 10 will be described.

As best illustrated in FIGS. 1 through 3, the folding work table 10 generally comprises a table top with a support leg structure pivotally coupled to a lower face of the table top adjacent a first end edge of the table top. A mounting board is pivotally coupled to a second end edge of the table top. The lower face of the table top has a generally U-shaped track with an elongate channel extending therealong. At least one C-clamp is provided having a generally C-shaped frame has a pair of opposing ends defining a break therebetween. One of the ends of the frame of the C-clamp has a pivot ball slidably disposed in the channel of the track.

In closer detail, the folding work table 10 comprises a generally rectangular table top 11 having substantially planar upper and lower faces 12,13, and a generally rectangular outer perimeter comprises first and second substantially parallel end edges 14,15, and a pair of substantially parallel side edges 16,17 extending substantially perpendicular to the end edges of the table top. The outer perimeter of the table top also preferably has a first pair of rounded corners 18*a*,18*b* adjacent the first end edge of the table top and a second pair of rounded corners 19*a*,19*b* adjacent the second end edge of the table top. Each of the rounded corners the first pair of rounded corners has a radius of curvature greater than a radius of curvature of either rounded corner of the second pair of rounded corners.

A support leg structure 20 is pivotally coupled to the lower face of the table top adjacent the first end edge of the table top. In use, the support leg structure is pivotable between extended and folded positions. As illustrated in FIG. 1, the support leg structure is extended substantially perpendicularly outwards from the lower face of the table when the support leg structure is positioned in the extended position to permit engagement of the support leg structure with a ground or floor surface to support the table top above the ground or floor surface. With reference to FIG. 2, the support leg structure is extended substantially parallel to the lower face of the table top and extended in a direction from the first end edge towards the second end edge of the table top when the support leg structure is positioned in the folded position.

An elongate generally rectangular mounting board 21 is pivotally coupled to the second end edge of the table top by a hinge such as a piano hinge such that mounting board extends between the side edges of the table top and substantially parallel to the second end edge of the table top. In use, the mounting board is designed for attachment to a structure such as a wall or countertop structure spaced above a ground or floor surface such that the second end edge of table top is spaced above the ground surface. Preferably, the mounting board has a plurality of mounting holes 22 therethrough each designed for extending fasteners therethrough to attach the mounting board to the structure. In use, the table top is pivotable with respect to the mounting board when the mounting board is attached to the structure between a generally horizontal deployed position (FIG. 1) and a generally vertical folded up position (FIG. 2) where the table top is upwardly extended from the location where the mounting board attached to the structure. Ideally, a latch 23 is mountable to the wall structure to releasably hold the table top in the folded up position.

With reference to FIGS. 2 and 3, the lower face of the table top has a generally U-shaped track 24 coupled thereto. The track comprises a spaced apart pair of substantially parallel elongate side portions 25,26, and an elongate cross portion 27 connecting the side portions of the track together and is extended substantially perpendicular to the side portions of the track. The cross portion of the track is positioned adjacent to and extended substantially parallel to the first end edge of the table top.

The track has a pair of rounded corners 28*a*,28*b* connecting the cross portion to the side portions of the track such that the cross portion is interposed between the rounded corners of the track. One of the rounded corners of the track is positioned adjacent one of the rounded corners of the first pair of rounded corners of the table top and the other of the rounded corners of the track is positioned adjacent the- other of the rounded corners of the first pair of rounded corners of the table top.

The side portions of the track is extended from the cross portion of the track towards the second end edge of the track, one of the side portions of the track is positioned adjacent to and extended substantially parallel to one of the side edges of the table top. The other of the side portions of the track is positioned adjacent to and extended substantially parallel to the other of the side edges of the table top. The side portions of the track each terminates at a free end 29,30 located adjacent the second end edge of the table top and opposite the cross portion of the track.

The track has an elongate channel 31 extending thereal-ong between the free ends of the side portions of the track and facing outwardly in a direction away from the lower face of the table top. As best illustrated in FIG. 3, the track has a generally rectangular-U-shaped transverse cross section and comprises a spaced apart pair of substantially parallel side walls 32,33 and a base wall 34 connecting the side walls together. The side walls and the base wall define the channel of the track.

The base wall of the track is coupled to the lower face of the table top. The side walls of the track each have an end flange 35,36 extending inwardly into the channel and extending along the length of the channel. The end flanges preferably face one another and is spaced apart from the base wall of the track.

At least one C-clamp 37,38 is provided having a generally C-shaped frame 39 has a pair of opposing ends 40,41 defining a break therebetween. Each C-clamp further comprises an operating screw 42 threadably extended through a threaded bore through a first of the ends of the frame of the C-clamp towards a second of the ends of the frame of the C-clamp. The operating screw has a turn handle 43 for threadably advancing and retracing in the operating screw in the first end of the frame.

The second end of the frame of the C-clamp has a generally spherical pivot ball 44 facing the first end of the frame of the C-clamp. The pivot ball is slidably disposed in the channel of the track to permit sliding of the pivot ball in the channel along the length of the track between the free ends of the side portions of the track to permit adjustable positioning of the C-clamp along the outer perimeter of the table top. The end flanges of the track holding the pivot ball in the channel while permitting the sliding of the pivot ball in the channel.

In use, as illustrated in FIG. 3, the pivot ball is pivotable in the channel to permit positioning of the C-clamp in a location where the table top is positioned between the ends of the frame of the C-clamp with the first end of the frame and the operating screw facing the upper face of the table top.

Preferably, the side portions of the track each has a cutout 45,46 in an inner one of the side walls of the track adjacent the free end of the respective side portion so that the cutouts face inwards from the outer perimeter of the table top towards one another. As shown in FIG. 2, the cutouts each are designed for receiving a portion of the frame of the C-clamp such that the C-clamp may be positioned generally parallel to the lower face of the table top when the C-clamp is positioned adjacent either free end.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A table, comprising:

a table top having upper and lower faces, first and second end edges, and a pair of side edges extending to said end edges of said table top;

a support leg structure being pivotally coupled to said lower face of said table top adjacent said first end edge of said table top;

a mounting board being pivotally coupled to said second end edge of said table top;

said lower face of said table top having a generally U-shaped track;

said track having an elongate channel extending thereal-ong;

at least one C-clamp having a generally C-shaped frame having a pair of opposing ends defining a break ther-ebetween;

said C-clamp further comprising an operating screw threadably extended through a first of said ends of said frame of said C-clamp; and a second of said ends of said frame of said C-clamp having a pivot ball slidably disposed in said channel of said track.

2. The table of claim 1, wherein said mounting board has a plurality of mounting holes therethrough each adapted for extending fasteners therethrough.

3. The table of claim 1, wherein a cross portion of said track is positioned adjacent to said first end edge of said table top, and wherein said side portions of said track are extended from said cross portion of said track towards said second end edge of said track, one of said side portions of said track being positioned adjacent to one of said side edges of said table top, the other of said side portions of said track being positioned adjacent to the other of said side edges of said table top.

4. The table of claim 1, wherein said track has a spaced apart pair of side walls defining said channel, wherein said side walls of said track each have an end flange extending inwardly into said channel.

5. The table of claim 1, wherein said track has at least one cutout into said channel of said track.

6. A table, comprising:

a generally rectangular table top having substantially planar upper and lower faces first and second substan-tially parallel end edges, and a pair of substantially parallel side edges extending substantially perpendicu-lar to said end edges of said table top;

said table top having a first pair of rounded corners adjacent said first end edge of said table top and a second pair of rounded corners adjacent said second end edge of said table top, each of the rounded corners said first pair of rounded corners having a radius of curvature greater than a radius of curvature of either rounded corner of said second pair of rounded corners;

a support leg structure being pivotally coupled to said lower face of said table top adjacent said first end edge of said table top;

said support leg structure being pivotable between extended and folded positions;

said support leg structure being extended substantially perpendicularly outwards from said lower face of said table when said support leg structure is positioned in said extended position;

said support leg structure being extended substantially parallel to said lower face of said table top and extended in a direction from said first end edge towards said second end edge of said table top when said support leg structure is positioned in said folded position;

an elongate mounting board being pivotally coupled to said second end edge of said table top such that mounting board extends between said side edges of said table top and substantially parallel to said second end edge of said table top;

said mounting board being adapted for attachment to a structure;

said mounting board having a plurality of mounting holes therethrough each adapted for extending fasteners therethrough to attach said mounting board to the structure;

said lower face of said table top having a generally U-shaped track, said track comprising a spaced apart pair of substantially parallel elongate side portions, and an elongate cross portion connecting said side portions of said track together and being extended substantially perpendicular to said side portions of said track;

said cross portion of said track being positioned adjacent to and extended substantially parallel to said first end edge of said table top;

said side portions of said track being extended from said cross portion of said track towards said second end edge of said track, one of said side portions of said track being positioned adjacent to and extended substantially parallel to one of said side edges of said table top, the other of said side portions of said track being positioned adjacent to and extended substantially parallel to the other of said side edges of said table top;

said side portions of said track each having a free end located adjacent said second end edge of said table top and opposite said cross portion of said track;

said track having an elongate channel extending therealong between said free ends of said side portions of said track and facing outwardly in a direction away from said lower face of said table top;

said track having a generally rectangular-U-shaped transverse cross section and comprising a spaced apart pair of substantially parallel side walls and a base wall connecting said side walls together, said side walls and said base wall defining said channel of said track;

said base wall of said track being coupled to said lower face of said table top;

said side walls of said track each having an end flange extending inwardly into said channel, said end flanges facing one another and being spaced apart from said base wall of said track;

at least one C-clamp having a generally C-shaped frame having a pair of opposing ends defining a break therebetween;

said C-clamp further comprising an operating screw threadably extended through a first of said ends of said frame of said C-clamp towards a second of said ends of said frame of said C-clamp;

said second end of said frame of said C-clamp having a generally spherical pivot ball facing said first end of said frame of said C-clamp;

said pivot ball being slidably disposed in said channel of said track to permit sliding of said pivot ball in said channel along said track between said free ends of said side portions of said track;

said end flanges of said track holding said pivot ball in said channel;

said pivot ball being pivotable in said channel to permit positioning of said C-clamp in a location where said table top is positioned between said ends of said frame of said C-clamp with said first end of said frame and said operating screw facing said upper face of said table top; and said side portions of said track each having a cutout in one of said side walls of said track adjacent said free end of the respective side portion, said cutouts facing towards one another.

* * * * *